United States Patent [19]

Bakkeren

[11] 4,061,084

[45] Dec. 6, 1977

[54] DEVICE FOR TRANSPORTING UNSTABLE STACKS OF SHEETLIKE MATERIALS

[76] Inventor: Hans Adolf Bakkeren, Barneveldseweg 89, Nijkerk, Netherlands

[21] Appl. No.: 531,359

[22] Filed: Dec. 10, 1974

[30] Foreign Application Priority Data

Dec. 11, 1973 Netherlands ..... 7316943

[51] Int. Cl.[2] ..... B65B 13/18

[52] U.S. Cl. ..... 100/1; 100/34; 211/50; 220/4 F; 248/206 A

[58] Field of Search ..... 100/1, 34; 271/213, 271/223; 220/4 F; 206/818; 217/13; 211/50; 248/206 A

[56] References Cited

U.S. PATENT DOCUMENTS

| | | | |
|---|---|---|---|
| 305,508 | 9/1884 | Bulkeley | 100/34 |
| 2,586,736 | 2/1952 | Onge | 100/1 |
| 2,599,290 | 6/1952 | Schwenzer | 100/1 |
| 2,652,930 | 9/1953 | Christenson | 211/50 |
| 3,268,343 | 8/1966 | Stock | 100/1 |

FOREIGN PATENT DOCUMENTS

| | | | |
|---|---|---|---|
| 559,884 | 3/1944 | United Kingdom | 220/4 F |

*Primary Examiner*—Billy J. Wilhite
*Attorney, Agent, or Firm*—Bucknam and Archer

[57] ABSTRACT

Method and apparatus for use in transporting unstable stacks of sheet material whereby releasably interconnected supports constrain the sides of the stack against slippage and such supports are positioned to provide gaps for passing strapping material about the stack.

4 Claims, 9 Drawing Figures

DEVICE FOR TRANSPORTING UNSTABLE STACKS OF SHEETLIKE MATERIALS

This invention relates to an apparatus for transporting unstable stacks of sheetlike material, such as paper, between a device for forming the stack and a strapping device.

In newspaper printing offices, in particular in big plants where modern installations are applied, the printing presses usually available in multiple-have a high production which is received by stacking devices directly adjoining the printing presses and producing stacks of a predetermined number of newspapers. These stacks must move past a number of strapping devices in order to form packages of newspapers suitable to be transported to the points of distribution.

The stacks produced by the stacking devices are thereby conveyed via conveyor belts to the strapping devices. In the course of this operation considerable problems regularly arise since the stacks, in particular the fresh stacks of newspapers, have little stability, not to say no stability, and fall apart on the slightest provocation. The result is that the transport means between the stacking device and the strapping device move very slowly because rapid movements would result in the disintegration of the stack. Although one has succeeded in raising the production capacity of the stacking device and of the strapping device sufficiently to meet the high production rate of the printing presses, yet the required production capacity is not arrived at because between the stacking device and the strapping device the speed is too low. Since the strapping devices may experience periods of standstill, for example when a new stock of tape has to be put in, but the stacking devices, however, continue to produce, the transport arrangements between the stacking devices and the strapping devices are often embodied such as to create the possibility of conveying the formed stacks to various strapping devices. However, this results in a change of direction which considerably increases the risk of a stack falling apart.

The object of the present invention is to provide a solution for this problem which, although it presents itself in particular in the case of transport of newspapers, also requires a solution in a broader sense.

This object is arrived at according to the invention in that the stack is arranged or formed in a holder or frame supporting at least all sides of the stack. The result is that in case of an acceleration or retardation respectively the stack remains intact. As a consequence one may adapt the transport speed between the stacking devices and the strapping devices to the high speed of operation of said devices and one may apply changeover devices without any objection so that the stacks which become available can be supplied to the strapping devices in operation.

It will be preferred to remove the holder or frame at the strapping device in order not to add additional weight to the further transport of the newspapers to the distribution stations. It is, however, conceivable to have the frame consist of an envelope of flexible material enclosing the stack, such as for example a sheet of synthetic material. Such an envelope is capable of keeping the newspapers of the stack in place, but will yield when the stack is strapped with the aid of wire-like or tape-like material. If required said envelope may consist of elastic material. However, such envelopes can only be used once and therefore increase the cost.

It is to be noted that there are machines that cover the stack with shrink foil extending over the top surface, the bottom surface and two sides. This system is not satisfactory because transport to this machine is required and during transport the foil is not sufficiently firm and gets stuck between moving parts.

It is preferred to use holders or frames which may be used over and over again. This means that the frames should be constructed such as to allow strapping. They must therefore present a passage for the strapping material. This is arrived at according to the invention in that the frame consists of a container or box rectangular in top plan view, the rigid sides and the bottom (if present) of which are divided according to two planes of division of the container extending perpendicularly to one another and the parts of the container are interconnected by engageable and disengageable coupling members. This means that the frame consists of four parts which can be combined to a container or box but which can be separated again at the strapping device and thus may be moved apart so that space becomes available for allowing the passage of the strapping loops. Such engageable and disengageable coupling members or latches are conceivable in many embodiments. One may use for instance manually operated latches but within the scope of a high rate of production automatically operated locking means, such as bolts that are released by insertion pins, are more suitable. A simple construction is arrived at if one couples the frame parts to one another by means of magnets, if particular permanent magnets. These magnets ensure that the container or box constitutes a sufficiently rigid unit to transport the stack of newspapers. At the strapping device the gripping force of the magnets is then eliminated or interrupted which may be done in a simple manner by moving the frame parts apart with means suitable for this purpose. According to the invention it is possible to effect this with the aid of the strapping material itself and for this purpose the edges of the seams between the frame parts are profiled such that the seams can be opened by the strapping tape. The strapping material cuts as it were through the wall of the frame since the magnets ensure that after the passing of the strapping material the seam is closed again. The strapping devices then produce frames containing a strapped stack. After having been emptied the frames can be used again. Of course the bottom of the frame, if any, should have a recess in order that the closing mechanism may reach the wire or tape ends to be interconnected.

However, if the frame is equipped with operable locking members, it is preferred according to the invention to embody said frame such that the four frame parts defined by the planes of division extending perpendicularly to one another present a distance between the edges facing one another which at least at the side walls is bridged by the locking members that keep only said parts together and spaced. This embodiment is of great importance if the weight of the stack contained in the frame impedes or hampers the moving apart of the frame parts and this is in particular the case when this moving apart is effected by the strapping material itself which must temporarily interrupt the connection consisting for example of magnets. The forces then to be exerted cannot always be brought about with the existing strapping machines.

This situation is still accentuated if newspapers are involved which at the strapping device are compressed with the aid of a pressing bar. This pressing bar will not only compress the stack of newspapers but will also press the frame bottom firmly against the work table of the strapping device so that the frame parts cannot easily move apart. Since the frame presents continuous interruptions in the form of spacing at the two planes of division, which are bridged exclusively by the locking members, the result is that after the disengaging of the locking members, at the point where the strapping must be laid, there are no frame parts at all because the strapping can be laid through the gap formed by the spacing directly around the compressed stack.

After completion of the strapping these locking members may easily be engaged again in some manner.

The locking members preferably consist of a locking bolt which is spring-biased and is arranged on one part for cooperation with an operable pawl and an operable spacer. The pawl is thereby coupled to an arm or pin projecting beyond the upper edge, said arm or pin being urged by a spring into the locking position. However, another mode of operation of the pawl is also conceivable. In case said pawl is operated against the spring action, the locking bolt is released and is retracted under spring tension into the other part, the spacer being simultaneously disengaged. This spacer is necessary because otherwise the parts are drawn together by the spring acting on the locking bolt. The operation of the pawl may be effected by means of the pressing bar which reaches the operating members for the pawl at the end of its working stroke.

The spacer can be embodied and operated in a manner similar to the locking bolt. It is preferred to have the spacer coupled to the locking bolt. This spacer may comprise a pawl provided on the locking bolt and blocking the bolt in the slidout position, the spacer being operated at the same time with the first-mentioned pawl. However, the spacer preferably consists of a rod or pin movable parallel to the locking bolt in opposite direction, said rod or pin being adapted to be coupled to the bolt via a gear wheel and a gear rack transmission. Consequently when the locking bolt is unlocked it moves the spacer in the opposite direction, whereas when the locking bolt is moved again into the operative position the spacer is also moved into the operative position.

The operation of the locking bolt can be realized in a simple manner by providing on the locking bolt an outwardly projecting operating pin which projects from the side wall in transverse or longitudinal direction and can be operated by means of stops or by means of operating members to be provided at the strapping device, said operating members receiving an operating signal at the end of the strapping cycle.

According to the invention the frame can be a box the side wall parts of which are hinged to the bottom, said side wall parts being also interconnected at the corners by engageable and disengageable coupling members, such as magnets. Such boxes can be developed in a flat plane, which simplifies their use, since the non-used boxes require little space. Furthermore it is possible to apply such boxes with advantage in the stacking device by forming the stack on a removable support above the developed box so that after the forming of the stack and the removal of the support the stack drops onto the developed box. This box is positioned above an aperture and will move downwards when the side walls simultaneously fold back. One may also conceive to form the stack on the developed box and to bring about the downward movement with a simultaneous folding back of the sidewalls upon a predetermined weight being reached. Also for the purpose of emptying such a box this possibility of folding open can be very useful.

With the present invention one succeeds in effectively solving the ever existing problem of the transport of newspapers and the like without the necessity of important changes in the stacking device and strapping device respectively. For the transport between said devices one may now use modern and rapid transport means. The frames can be made from any suitable material.

The invention will now be further explained with reference to the drawings.

Figure 1:
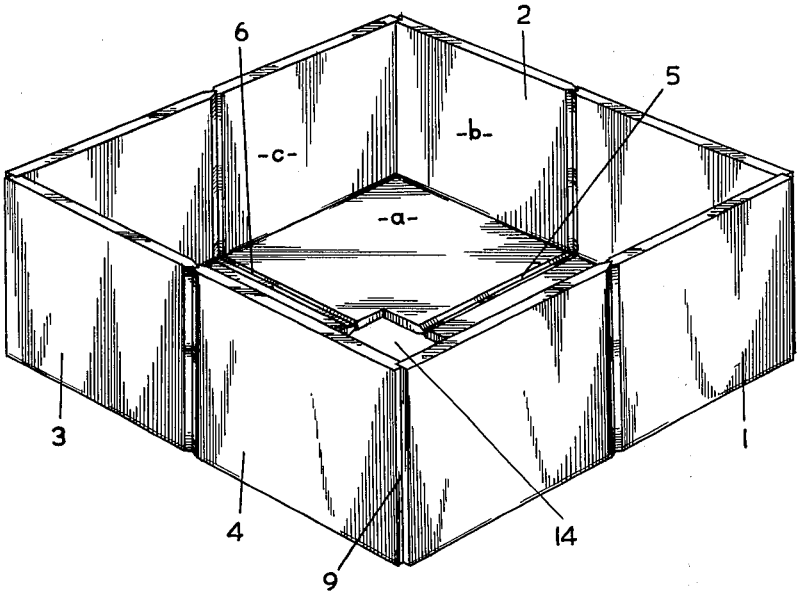
FIG. 1 shows in perspective an example of a frame according to the invention.
Figure 2:
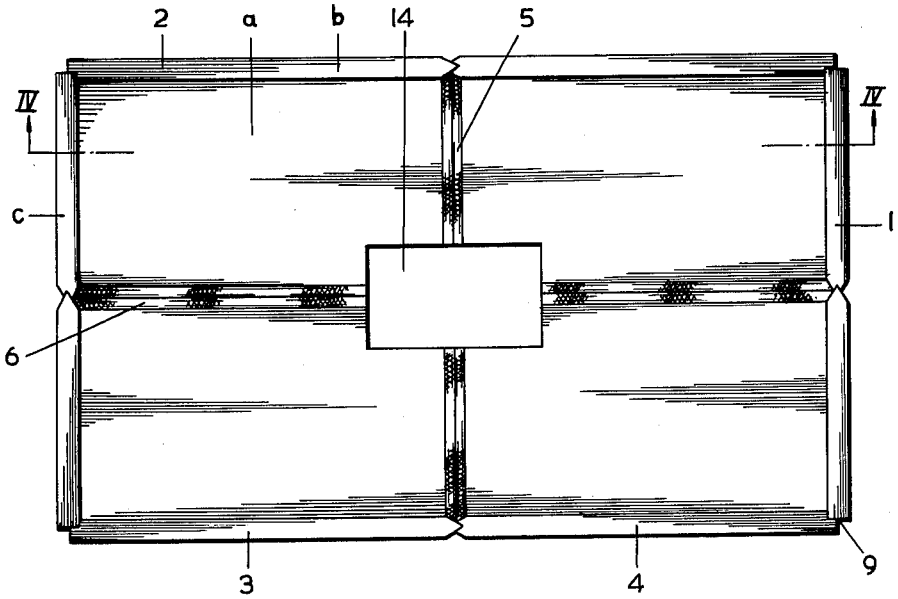
FIG. 2 is a top plan view of a frame according to the invention.

The frame shown in FIGS. 1 and 2 consists of four parts 1, 2, 3 and 4 each consisting of a bottom *a* and side walls *b* and *c* respectively. The frame is divided according to middle planes of division constituting the seams 5 and 6 respectively and extending perpendicularly to one another.

Figure 4:
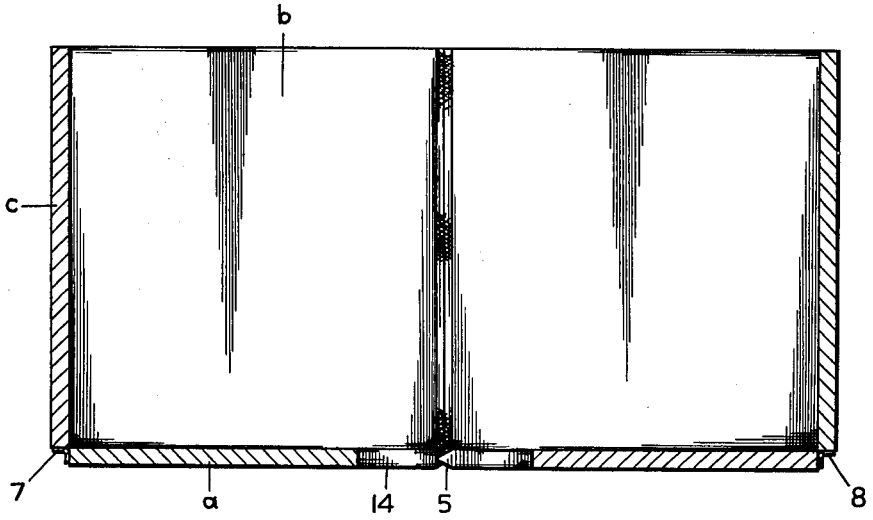
FIG. 4 is a section according to the line IV—IV of FIG. 2.
Figure 6:
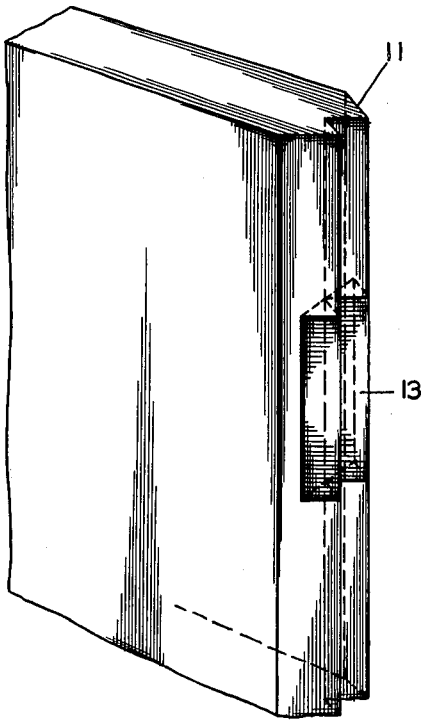
FIGS. 5 and 6 show in perspective views of parts of the frame of FIGS. 1 and 2.
Figure 5:
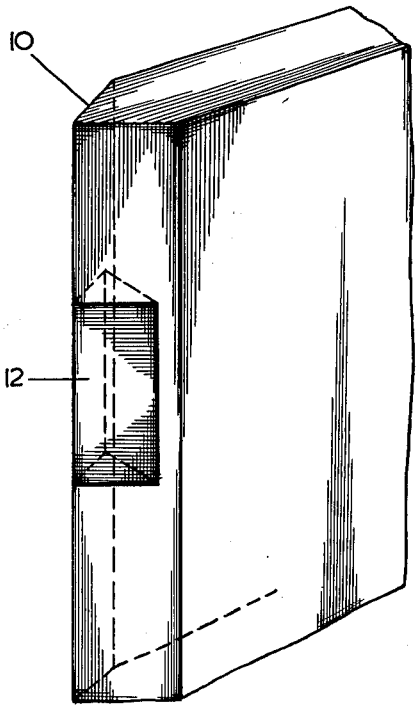

As indicated in FIG. 4 the vertical side walls of the box may be secured to the bottom with the aid of hinges 7 and 8 and may form a vertical seam 9 in the corners.

It is, however, conceivable to embody each part 1 to 4 incl. such that bottom 1 and side walls *b* and *c* respectively constitute one rigid unit.

At the seams 5 and 6 the parts 1 to 4 incl. fit properly together in that one part has an edge 10 of V-shaped section and the other part an edge 11 of W-shaped section, magnets 12 and 13 respectively having been recessed in said edges. The result of this profiling is that the seams form an outwardly open V-shaped groove into which the strapping material can penetrate which upon tensioning of the strapping loop presses these parts apart.

Each bottom part 1 also comprises a recess 14. These recesses constitute together an aperture for the closing mechanism of the strapping machine.

Figure 8:
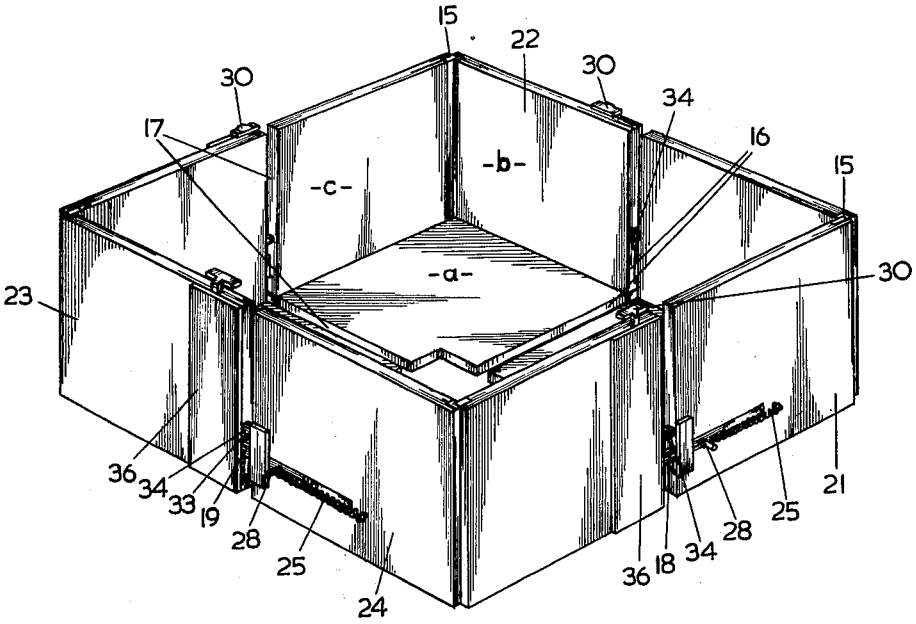
FIG. 8 shows the frame as embodied according to FIG. 7 in the same way as FIG. 1 in perspective.
Figure 9:
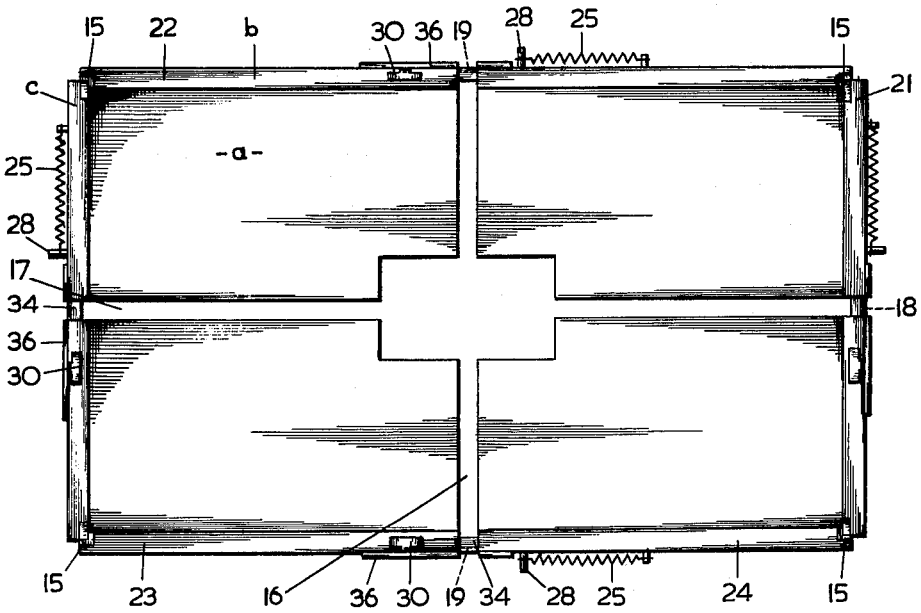
FIG. 9 shows the frame of FIG. 8 in a manner corresponding to FIG. 2.

The frame shown in FIGS. 8 and 9 essentially corresponds to the one shown in FIGS. 1 and 2, which means that each of the four parts consists of a bottom part *a* and two side parts *b* and *c*. The side wall parts *b* and *c* are connected by means of hinges to the bottom part *a* in the manner as shown in FIG. 4. In the erected position the coupling of the side wall parts to one another is effected with the aid of permanent magnets arranged in the corners, as indicated by reference numeral 15. The embodiment shown in FIGS. 8 and 9 differs from the one according to FIGS. 1 and 2 in that on the edges of parts 21, 22, 23 and 24 there are distances or gaps 16, 17 which are exclusively bridged by bolts 18 and 19 respectively.

Figure 7:
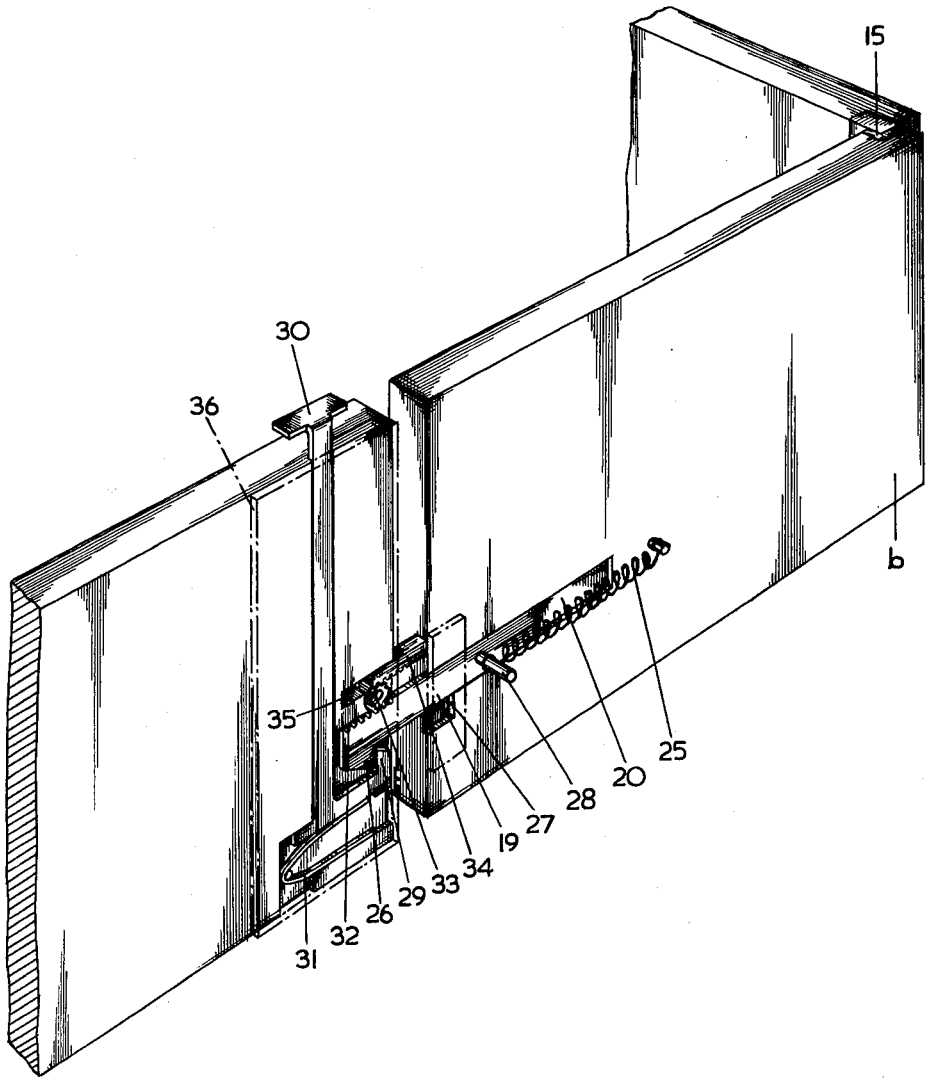
FIG. 7 shows in perspective a detail of a frame comprising engaging and disengaging coupling members.

FIG. 7 shows a possible embodiment of the locking members. The locking bolt 19 shown in FIG. 7 is slidable in a recess 20 of a side wall *b* and is influenced by a tension spring 25 that tries to move the locking bolt 19 into the retracted position in which it is positioned with the hook-like end 26 entirely in the corresponding recess 27.

The locking bolt 19 comprises in addition a projecting pin 28 with which the bolt 19 can be moved into the operative position as shown.

Instead of in the transverse direction such a pin may also project in the longitudinal direction of the bolt from the end of the wall *b*.

The hook-like end 26 of the locking bolt 19 cooperates with a panel 29 that is coupled to an operating rod 30 and is held by a spring 31 in the position holding the locking bolt. When the rod 30 is pressed downwards, the pawl 29 will release the locking bolt 19 so that the latter interrupts the connection and entirely releases the gap between the edges of the side wall parts *b* facing one another.

In the embodiment shown the upper edge of the locking bolt 19 is constructed as a gear rack 32 adapted to cooperate with a gear wheel 33 that cooperates with a slidable rod or pin 34 the lower side of which is provided with teeth.

It will be clear that when the locking bolt 19 is moved to the right by the gear wheel transmission, the rod or pin 34 is moved towards the left and is thereby accomodated in the recess 35.

When the locking bolt 19 is slid again into the operative position the meshing of the teeth of the bolt 19 with the gear wheel 33 will cause the rod 34 to be slid out and to form a stop which ensures that the parts of the frame stay apart and therefore the gap between the edges facing one another always has the same dimension.

Figure 3:
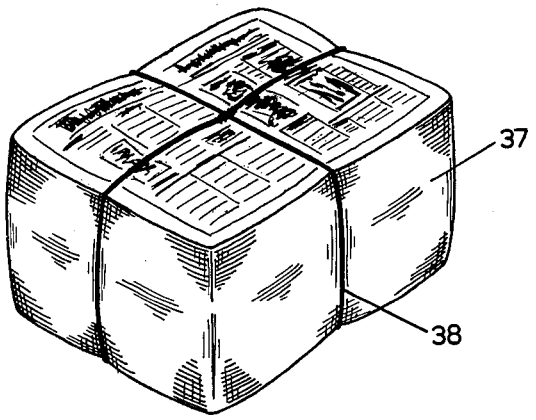
FIG. 3 shows in perspective a stack with a flexible enclosure.

Instead of the locking members shown naturally other embodiments may be conceived. For instance one may conceive locking members that are urged by springs into the operative position and that are pushed away by the pressing rod or a member secured thereto respectively, returning automatically into the operative position as soon as the pressing rod is lifted again. Also in that case the entire mechanism can be hidden from view by means of cover plates like 36. With regard to the embodiment shown in FIG. 3 it is to be noted for the sake of completeness that this Figure depicts a stack of newspapers, the sides of which are enclosed by a comparatively rigid envelope 37 of synthetic material, which, however, is sufficiently flexible to allow a strapping with tape material 38 and on the other hand is not so soft that the stack would not be supported.

I claim:

1. An apparatus for stabilizing an unstable stack of sheet material to facilitate the transportation thereof, which apparatus comprises a plurality of releasably interconnected support members disposed to engage respective sides of the stack over the height thereof to constrain the sheet material against edgewise slippage, said support members being positioned to provide gaps for passing strapping material about the stack, said support members having confronting inclined edge surfaces that are spreadable apart to establish said gaps when said surfaces are engaged by tensioned strapping material.

2. An apparatus according to claim 1 wherein said support members are releasably interconnected by means including a spring-biased locking bolt on one support member and cooperating with a pawl and spacer means on another corresponding support member.

3. An apparatus according to claim 1 wherein said support members include a plurality of aligned pairs of support members each pair disposed along one of four rectangularly arranged sides of the stack.

4. An apparatus for stabilizing an unstable stack of sheet material to facilitate the transportation thereof, which apparatus comprises a plurality of releaseably interconnected support members disposed to engage respective sides of the stack over the height thereof to constrain the sheet material against edgewise slippage, said support members being positioned to provide gaps for passing strapping material about the stack, and magnetic means on said support members and operable to releasably interconnect same.

* * * * *